United States Patent [19]

Bergsma

[11] 4,355,464

[45] Oct. 26, 1982

[54] SHAVING APPARATUS

[75] Inventor: Wijtse Bergsma, Drachten, Netherlands

[73] Assignee: U.S. Philips Corporation, New York, N.Y.

[21] Appl. No.: 189,972

[22] Filed: Sep. 22, 1980

[30] Foreign Application Priority Data

Oct. 18, 1979 [NL] Netherlands ..... 7907681

[51] Int. Cl.[3] ..... B26B 19/00

[52] U.S. Cl. ..... 30/34.1

[58] Field of Search ..... 30/34.1

[56] References Cited

U.S. PATENT DOCUMENTS 3,949,472 4/1976 Meyerhoefer ..... 30/34.1

FOREIGN PATENT DOCUMENTS 825851 12/1959 United Kingdom ..... 30/34.1

*Primary Examiner*—Jimmy C. Peters

*Attorney, Agent, or Firm*—Thomas A. Briody; William J. Streeter; Rolf E. Schneider

[57] ABSTRACT

There is provided a shaving apparatus comprising a drivable shaving member coupled to an electric motor by means of a gear-wheel transmission. The gear-wheel transmission includes a pinion on the motor shaft and a gear-wheel connected to the shaving member. The shaving apparatus has a trimmer coupled to the electric motor by an eccentric mechanism. The eccentric mechanism is coupled to the pinion on the motor shaft by means of an additional gear-wheel included in the gear-wheel transmission, the gear-wheel connected to the shaving member also being coupled to the pinion on the motor shaft through such additional gear-wheel.

1 Claim, 2 Drawing Figures

SHAVING APPARATUS

This invention relates to a shaving apparatus comprising a drivable shaving member which is coupled to an electric motor by means of a gear-wheel transmission, which gear-wheel transmission includes a pinion mounted on the motor shaft and a gear-wheel which is connected to the shaving member, which shaving apparatus is also provided with a trimmer, which is also coupled to the electric motor via an eccentric mechanism.

Such a shaving apparatus is for example known from U.S. Pat. No. 3,307,257. In this known apparatus the gear-wheel which is connected to the shaving member is integral with an eccentric cylindrical portion of the eccentric mechanism. As a result of this the revolution speed with which the shaving member is driven is equal to the frequency with which the trimmer is driven.

However, for optimum performance of the shaving section member and the trimmer it may be necessary to drive the shaving member with a revolution speed whose numerical value differs from the frequency with which the trimmer is driven. Moreover, there is a trend to drive the shaving members in shaving apparatuses at lower revolution speeds, thereby reducing wear, friction heat and noise. The frequency may then become too low for satisfactory operation of the trimmer.

The present invention, whose object it is to solve this problem, provides a construction which is characterized in that the eccentric mechanism is coupled to the pinion on the motor shaft by means of an additional gear-wheel.

A special embodiment is characterized in that the gear-wheel which is connected to the shaving member is also coupled to the pinion on the motor shaft via the additional gear-wheel.

A preferred embodiment is characterized in that the additional gear-wheel is a double gear-wheel, of which a first toothing is in mesh with the pinion on the motor shaft and a second toothing is in mesh with the gear-wheel which is connected to the shaving member, the additional gear-wheel also being provided with the eccentric cylindrical portion of the eccentric mechanism.

The invention will now be described in more detail with reference to the accompanying drawing, in which.

Figure 1:
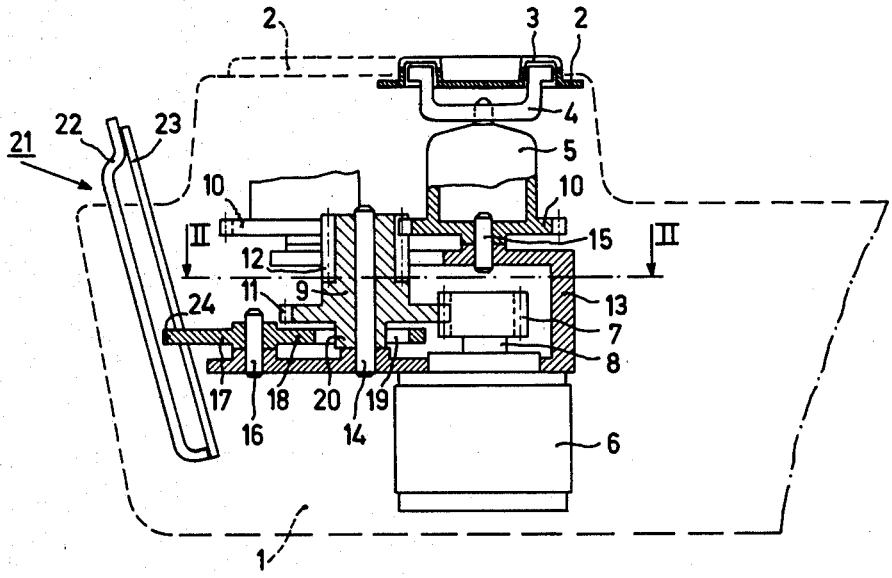
FIG. 1 shows a shaving apparatus schematically and partly in cross-section.

The shaving apparatus of FIG. 1 comprises a housing 1 having three stationary shaving elements 2. The shaving elements 2 are formed with hair-entry apertures 3. Co-operating with each shaving element 2 is a drivable shaving member 4, which is disposed on the end of a drive shaft 5. The drivable shaving members 4 are coupled to an electric motor 6 by means of a pinion 7 mounted on the motor shaft 8, a double gear-wheel 9 and three gear-wheels 10. Each of the gear-wheels 10 is integral with a drive shaft 5 and is thus connected to the drivable shaving member 4. The double gear-wheel 9 has a first toothing 11, which is in mesh with the pinion 7, and a second toothing 12, which is in mesh with the three gear-wheels 10.

The gear-wheels 9 and 10 are mounted for rotation on a mounting plate 13 by means of the spindles 14 and 15 respectively. By means of the spindle 16 the eccentric lever 17 is also mounted on the mounting plate 13 so as to be pivotal. One end 18 of this eccentric lever 17 is formed with an elongate opening 19, which engages with an eccentric cylindrical portion 20 of the double gear-wheel 9.

The eccentric cylindrical portion 20 and the eccentric lever 17 constitute the eccentric mechanism for driving the trimmer 21. The trimmer 21 comprises a stationary cutter 22 and a drivable cutter 23, with which the end 24 of the eccentric lever 17 engages.

Figure 2:
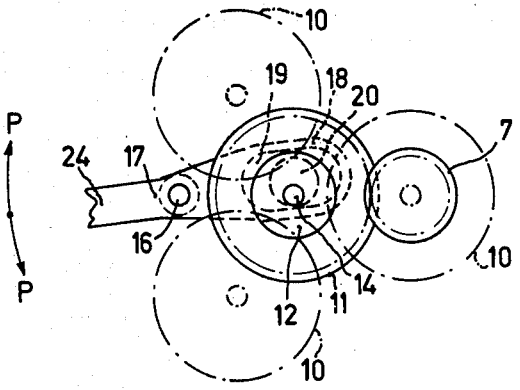
FIG. 2 is a cross-sectional view taken on the line II—II in FIG. 1.

Via the pinion 7, the double gear-wheel 9, the gear-wheels 10 and the drive shafts 5 the electric motor 6 drives the shaving members 4 with a rotary motion. At the same time the eccentric lever 17 is driven with a reciprocating motion relative to the spindle 16, as is indicated by the arrows P in FIG. 2. As a result of this reciprocating motion the drivable cutter 23 is reciprocated relative to the stationary cutter 22.

By the use of an additional gear-wheel in the form of the double gear-wheel 9 the frequency of the drivable cutter 23 and the revolution speed of the shaving members 4 can be selected independently of each other so that the performance of said members is optimized.

Obviously, it is not necessary that the additional gear-wheel is a double gear-wheel. In an alternative embodiment the additional gear-wheel for driving the eccentric mechanism is a single separate gear-wheel which is in mesh with the pinion on the motor shaft, said pinion also meshing directly with the gear-wheels 10 on the drive shafts, or being coupled directly to said gear-wheels 10 via one or more intermediate gear-wheels. It may then be necessary to make the pinion longer in the axial direction, so as to enable a plurality of gear-wheels, which are axially displaced relative to each other, to be in mesh with the pinion.

What is claimed is:

1. A shaving apparatus which comprises a drivable shaving member; an electric motor having a motor shaft; a gear-wheel transmission coupling the shaving member to the electric motor, said gear-wheel transmission including a pinion mounted on the motor shaft, a gear-wheel connected to the shaving member, and an additional gear-wheel; a trimmer; and an eccentric mechanism coupling the trimmer to the electric motor; the additional gear-wheel being a double gear-wheel having a first toothing in mesh with the pinion on the motor shaft and a second toothing in mesh with the gear-wheel connected to the shaving member, said additional gear-wheel also having an eccentric cylindrical portion forming part of the eccentric mechanism.

* * * * *